United States Patent [19]

Viapiano et al.

[11] 4,043,090

[45] Aug. 23, 1977

[54] ASSEMBLY OF PREFABRICATED ELEMENTS FOR FORMING WALLS OF PLANAR AND/OR NON-PLANAR CONFIGURATION

[76] Inventors: Ugo Viapiano, Centro Residenziale Parco Lambro, Stabile 6, 20090-Segrate (Milan); Odoardo Andreoni, Via dei Gelsi, 10-20094 Corsico (Milan), both of Italy

[21] Appl. No.: 616,947

[22] Filed: Sept. 26, 1975

[51] Int. Cl.[2] ..... E04C 1/30; E04C 2/06

[52] U.S. Cl. ..... 52/583; 52/584; 52/600

[58] Field of Search ..... 52/584, 583, 574, 580, 52/227, 587, 600; 61/58, 59

[56] References Cited

U.S. PATENT DOCUMENTS

| | | | |
|---|---|---|---|
| 598,631 | 2/1898 | Jetley | 52/585 |
| 2,089,763 | 8/1937 | Rotinoff | 61/59 |
| 2,099,543 | 11/1937 | Stevens | 61/59 |
| 2,192,509 | 3/1940 | Simpson | 61/59 |
| 2,229,779 | 1/1941 | Thomas | 52/583 |
| 2,877,506 | 3/1959 | Almoslino | 52/574 |
| 3,394,522 | 7/1968 | Maurer | 52/227 |

*Primary Examiner*—James L. Ridgill, Jr.
*Attorney, Agent, or Firm*—Steinberg & Blake

[57] ABSTRACT

A device for providing walls comprising prefabricated elements substantially in the shape of isosceles trapezoid, the elements being approachable to one another along oblique sides, and means for securing the elements to one another.

5 Claims, 4 Drawing Figures

ASSEMBLY OF PREFABRICATED ELEMENTS FOR FORMING WALLS OF PLANAR AND/OR NON-PLANAR CONFIGURATION

According to known techniques, the construction of any kind of walls is provided by fixedly or movably coupling elements of a shape comparable with right parallelopipeds having a rectangular base (such as solid bricks, hollow tiles and the like; cement or wood panels of solid or drummed type; boards; plywood sheets or the like).

Thereby, only straight walls can be provided, with a resulting considerable limitation in possible shapes.

Additionally, bond or connection between the various elements is assured by the adhesive or bonding agent or binder joining the surfaces of the various parts approached to one another.

Accordingly, two further disadvantages will arise, of which the first is the poor resistance of these wall against non-vertical strains or thrusts, and the second generally consisting of having to somehow cover these junctions, both for disguising the unattractive appearance and for protecting such junctions from external agents, these procedures involving undesirably large time and costs.

It is the basic object of the present invention to avoid at the same time all of the disadvantages above mentioned and to render the wall readily dismountable.

According to the present invention a device for building up walls is provided, the device being essentially characterized by comprising prefabricated elements, each of which is prismshaped of substantially isosceles trapezoid cross-section, so that by approaching a plurality of elements to one another along the oblique faces or sides of the prisms both straight and curved walls can be obtained, means being also provided for securing the elements to one another, thereby rendering the wall compact.

To better depict these and other features of a device comprising the modular prefabricated elements according to the present invention, an embodiment of the device according to the invention will now be described, and an embodiment of a wall comprising a plurality of elements will also be described, reference being had to the accompanying drawing, in which.

Figure 1:
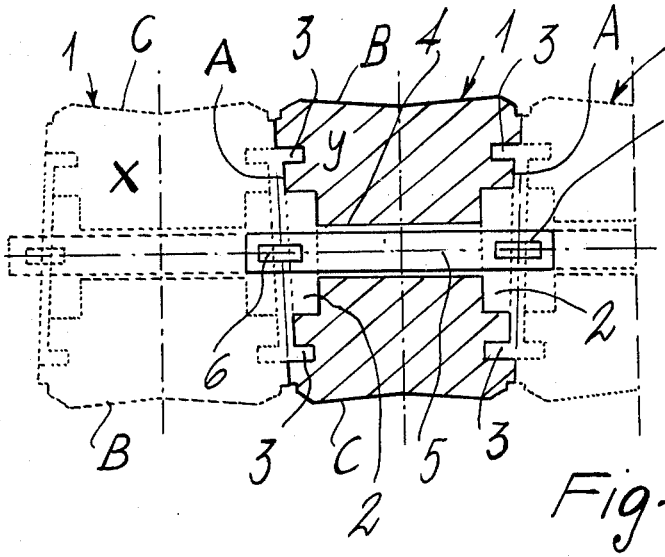
FIG. 1 is a sectional view taken along a horizontal plane and showing in dotted lines identical elements juxtaposed to a first element.
Figure 2:
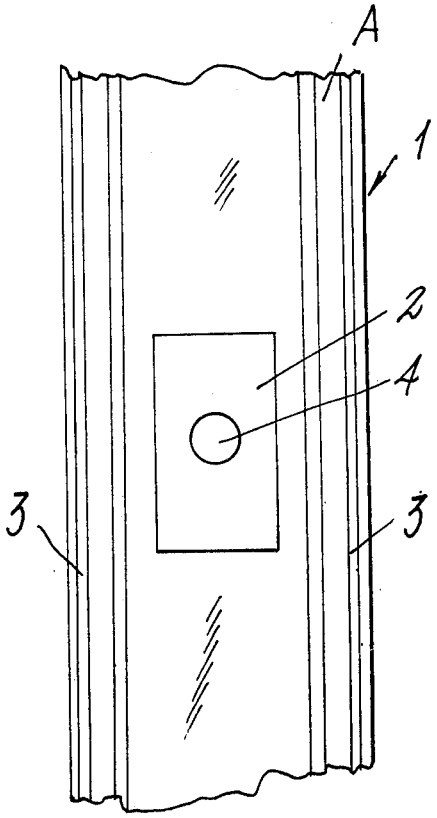
FIG. 2 is an elevational view of an element shown in FIG. 1.

The device comprises elements, each of which designated as a whole at 1 is a modular element; as explained hereinafter, elements 1 can be used for making building walls.

The element is substantially in the shape of a right prism having a substantially isosceles trapezoid shape in cross-section. More particularly, the horizontal section or each of the prism bases has two non-parallel sides, both of which designated by A, that is the oblique sides of the isosceles trapezoid, and other two substantially parallel sides, that is the major and minor bases of said trapezoid, designated by B and C, respectively.

For example, element 1 is a solid element, but could be a hollow element, and can be made of any suitable material.

Holes 4 are drilled through element 1 along the vertical at regular spacings, the element having at each of said holes 4 two recesses or notches, both of which are designated by 2. By mere way of unrestrictive example, holes 4 in an element 1 may be spaced apart by about 50 cm.

Means are provided as comprising connection member 5, substantially rectangular metal bars, and wedges 6 for securing elements 1 to one another to form a wall, as disclosed in the following.

Figure 3:
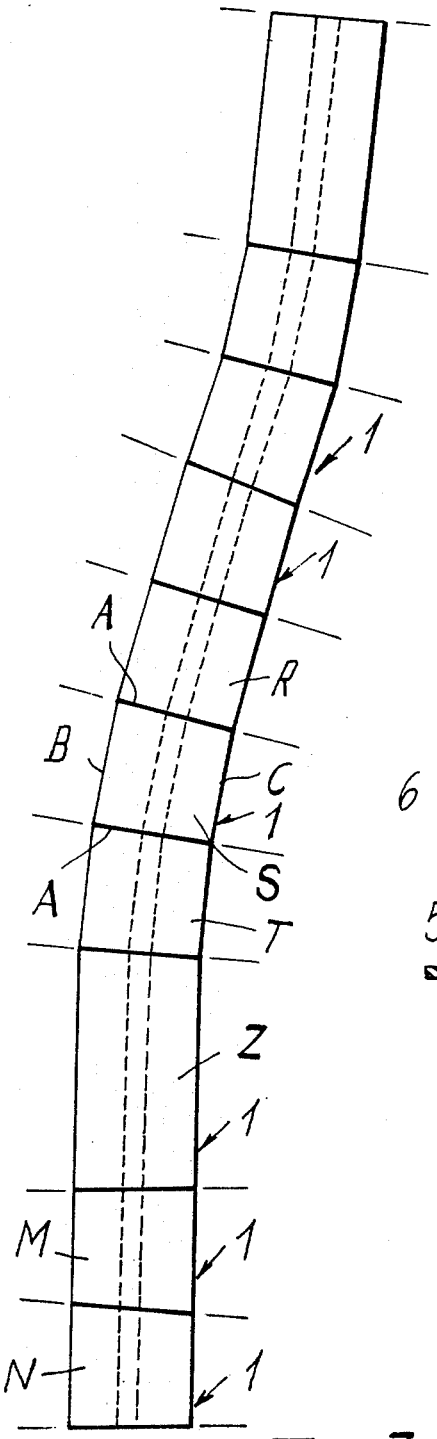
FIG. 3 is a plan view showing a wall made by some elements such as that shown in FIGS. 1 and 2.

By mere way of example, a wall is shown in a plan view in FIG. 3.

Coupling between elements 1 is provided by approaching such elements 1 to one another, as shown in FIG. 3, particularly approaching the oblique faces or sides of the prisms, corresponding to oblique sides A of the isosceles trapezoids. Such a coupling is shown, for example, in FIG. 1, where two elements 1 are shown in dotted lines approaching one element 1, depicted by full lines, just along the oblique sides A of the isosceles trapezoids.

To provide a straight wall, or a wall lying on a plane, each pair of adjoining elements 1 are approached to one another, so that their trapezoidal cross-sections are oriented in opposing directions. For example, this is the case of FIG. 1, where isosceles trapezoids X and Y, representing the horizontal sections of two elements 1 approached to each other, are opposite, that is side or major base B of trapezoid Y is substantially aligned with side or minor base C of trapezoid X, and side or minor base C of trapezoid Y lies on the side of major base or side B of trapezoid X. For example, the three elements 1, reespectively designated in FIG. 3 by M, N and Z, are approachd to one another to form a section or length of a straight wall.

On the other hand, when approaching to one another all of the various trapezoidal cross-sections are oriented in the same direction, such as those shown for example by R, S and T in FIG. 3, a length of curved or non-planar wall or substantially a prismatic wall is provided.

Figure 4:
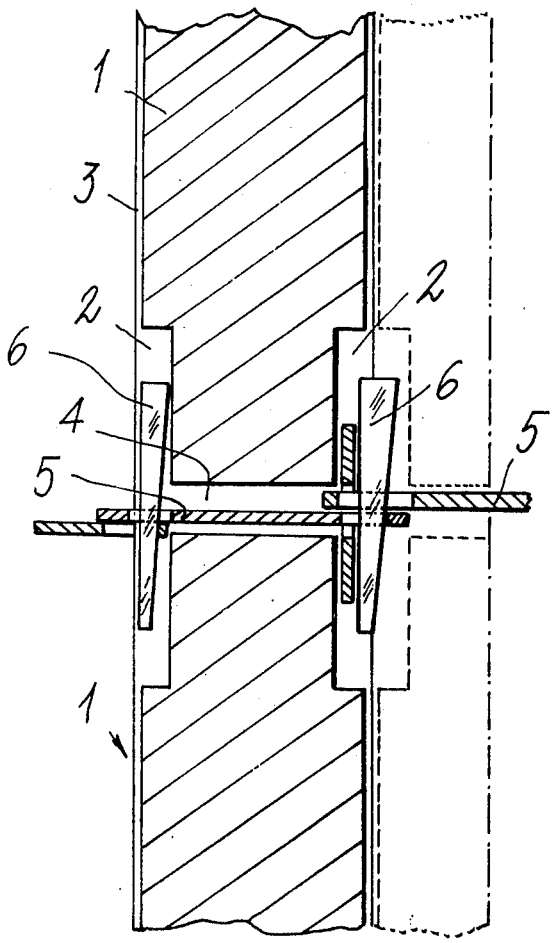
FIG. 4 is a sectional view of an element shown in FIGS. 1 and 2, and also showing the connection between two elements, one of which is shown by full lines and the other by dashed lines.

On making a wall, elements 1 are secured to one another, for example by the members above described, such as hooking elements 5 and wedges 6. Said hooking or connection members 5 pass through aligned holes 4 of elements 1, with clearance as illustrated in FIGS. 1 and 4, and wedges 6 are inserted into overlapping holes provided in end regions of adjoining members 5, so that said members 5 and wedges 6 provide chains holding elements 1 joined to one another. Thus, it will be seen that the wedges 6 form a plurality of pulling means each connected operatively with a pair of adjoining ends of connection members 5 for pulliing the ajoining members 5 toward each other and placing them in tension. Of course, means for securing elements 1 to one another may be different. It will be seen that each pulling means 6 and the pair of adjoining end regions of elements 5 connected therewith are situated in the space defined by a pair of aligned recesses 2, with the chain of successive connection members 5 and pulling means 6 each interconnecting adjoining elements 5 acting to press one of the non-parallel sides of one element 1 against one of the non-parallel sides of the next element 1.

Elements 1 can be also made of different size, for example element 1, also designated by Z, is of a different size with respect to those designated by M and N.

Vertical grooves 3 are provided for receiving seals or gaskets. Moreover, should the connectable elements be of a plurality of types, all of which having isosceles trapezoid cross-section of the same height and same oblique sides, but bases of different length, depending on the composition thereof, such elements can provide curves of different radius. Thus, coupling of said elements enables to provide straight, curved and counter-curved walls with extremely different radii, substantially without any limitation.

Such a coupling also affords an extremely high saving in time and costs, since the various elements, painting included, can be prepared by fully automatic machines, and as a result assembling work consists of approaching the elements and hooking on the various chains. With a similar ease, the wall can be disassembled and all of the material can be integrally recovered, or the wall can be modified.

For example, the height of element 1, or dimension at right angles to the plane of FIGS. 1 and 3, can be the same as that of the wall to be made, but the height could also be less and in this case elements 1 would be superimposed and suitably secured to one another, such as by adhesive or bonding agents, joints, etc.

What we claim is:

1. An assembly for making walls, comprising prefabricated elements, each of which is in the form of a prism having a substantially isosceles trapezoid cross- section, with each element having opposed parallel sides and opposed non-parallel sides, so that by approaching a plurality of said elements to one another at their non-parallel sides and by selecting the orientation of the trapezoidal cross-sections thereof, both planar and non-planar walls canbe provided, all of said elements being formed in said non-parallel sides thereof with recesses all of which are situated at the same elevation with pairs of said recesses adjoining each other at pairs of said non-parallel sides of said elements which are situated next to each other, and each of said adjoining pairs of recesses defining a space at a junction between adjoining elements where a pair of non-parallel sides thereof are situated, and each element being formed with a hole interconnecting and communicating with the recesses respectively situated at opposed non-parallel sides of each element, a plurality of connection members respectively extending with clearance through and beyond said holes into said recesses and forming pairs of adjoining connection members each having a pair of adjoining end regions situated in one of said spaces, and a plurality of pulling means respectively situated in said spaces witheach pulling means operatively connected with a pair of adjoining end regions of a pair of adjoining connection members situated in each space for pulling said connection members toward each other and placing them in tension in a manner pressing adjoining, non-parallel sides of said elements against each other.

2. An assembly according to claim 1 wherein said plurality of pulling means are removably connected with said end regions of said connection members to separate the elements, if desired.

3. An assembly according to claim 1, wherein said adjoining end regions of adjoining connection members overlap each other in said space and are respectively formed with holes which overlap each othere, each pulling means including a wedge passing through said overlapping holes.

4. An assembly according to claim 1, wherein the height of each element is the same as that of the wall to be made.

5. An assembly according to claim 1, wherein the height of each element is less than that of the wall to be made, the elements being superimposable and connectable to one another.

* * * * *